US008656544B1

(12) United States Patent
Anderson

(10) Patent No.: US 8,656,544 B1
(45) Date of Patent: Feb. 25, 2014

(54) SWEEPER WITH SWEEPING ELEMENTS

(76) Inventor: Kenneth Anderson, Camarillo, CA (US)

( * ) Notice: Subject to any disclaimer, the term of this patent is extended or adjusted under 35 U.S.C. 154(b) by 434 days.

(21) Appl. No.: 13/182,086

(22) Filed: Jul. 13, 2011

(51) Int. Cl.
*A47L 5/30* (2006.01)

(52) U.S. Cl.
USPC ..... 15/41.1; 15/49.1; 15/52.1; 15/98; 15/383; 15/389

(58) Field of Classification Search
USPC ..... 15/41.1, 49.1, 89–90, 98, 382–384, 15/389–391, 52.1, 207.2, 50.3
See application file for complete search history.

(56) References Cited

U.S. PATENT DOCUMENTS 1,675,059 A * 6/1928 Sharp ..... 15/383
1,919,067 A * 7/1933 Lang et al. ..... 15/383
3,619,948 A * 11/1971 Burns ..... 451/178
4,221,018 A * 9/1980 Hajdu ..... 15/347
4,445,245 A * 5/1984 Lu ..... 15/23
4,480,350 A * 11/1984 White ..... 15/207.2
5,148,569 A 9/1992 Jailor et al.
5,794,297 A * 8/1998 Muta ..... 15/42
2004/0181888 A1 9/2004 Tawara et al.
2005/0160555 A1* 7/2005 Mayes ..... 15/384
2005/0217042 A1 10/2005 Reindle

FOREIGN PATENT DOCUMENTS

GB 2376875 * 12/2002 ..... A47L 11/34

* cited by examiner

*Primary Examiner* — Laura C Guidotti

(57) ABSTRACT

The present invention is a sweeper incorporating multiple rotation elements mounted adjacently in an rotationally offset sequence on a common driven axle. Each rotation element comprises a central shaft support from which extends light-weight extension arms that have laterally elongated spatulate paddles at their ends. The extension arms may be curved so that in operation a terminal edge of each paddle lags the rest of the paddle surface in approaching and sweeping across the floor surface and is quite easily deflected upward from a floor surface.

13 Claims, 11 Drawing Sheets

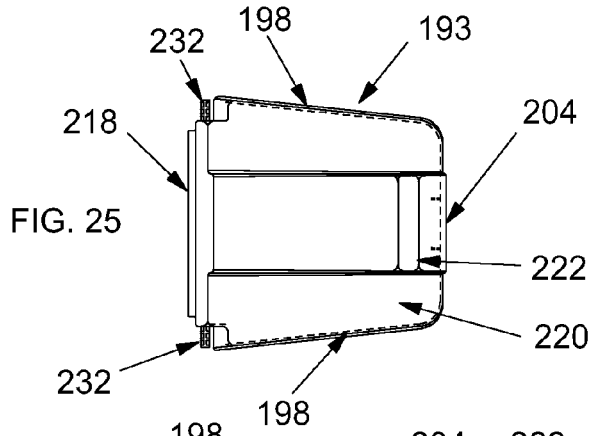
FIG. 25
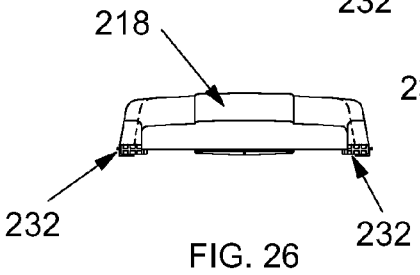
FIG. 26
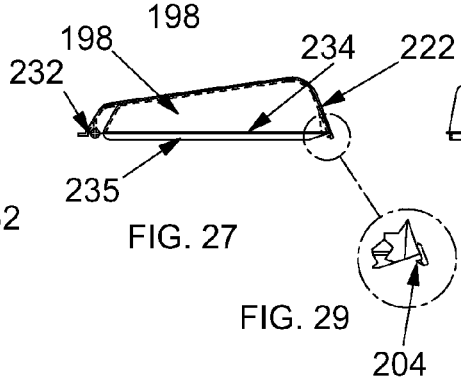
FIG. 27
FIG. 29
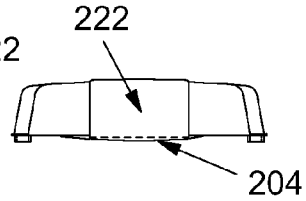
FIG. 28
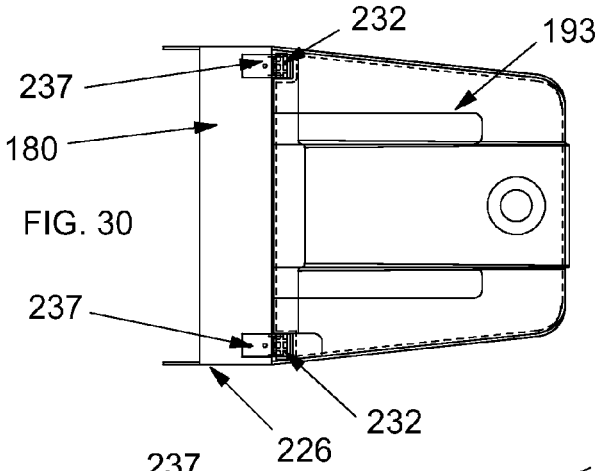
FIG. 30
FIG. 31
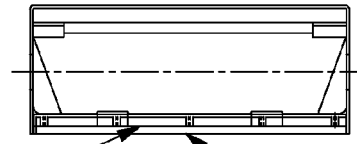
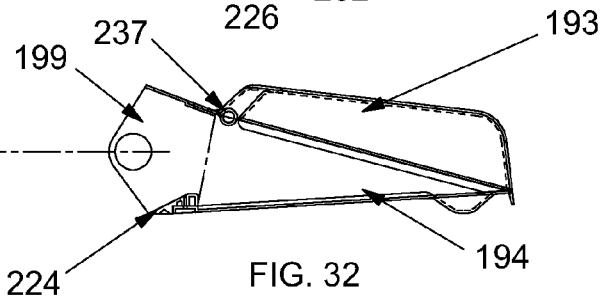
FIG. 32

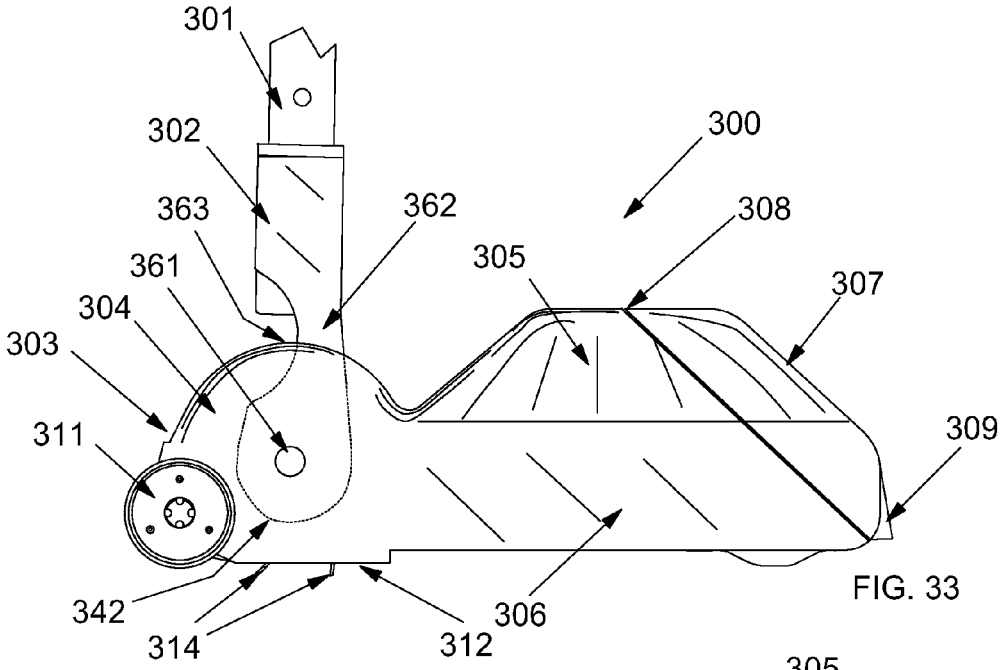
FIG. 33
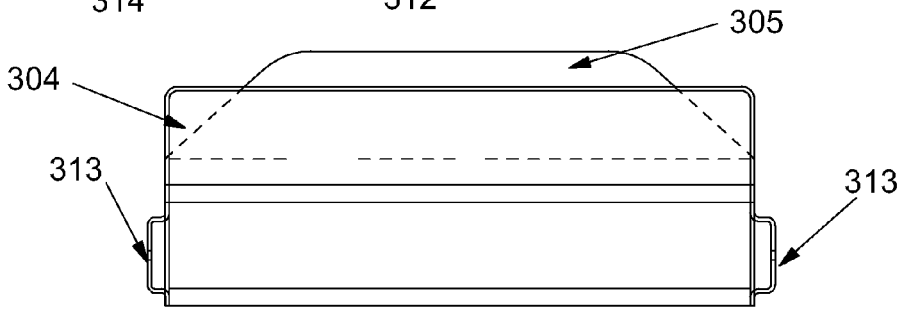
FIG. 34
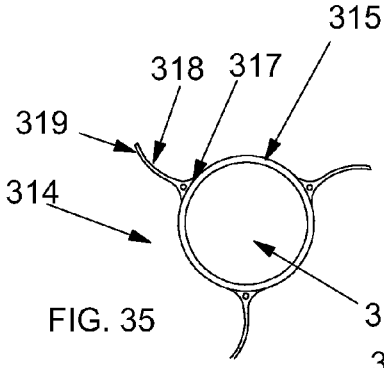
FIG. 35
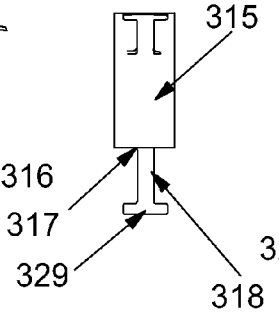
FIG. 36
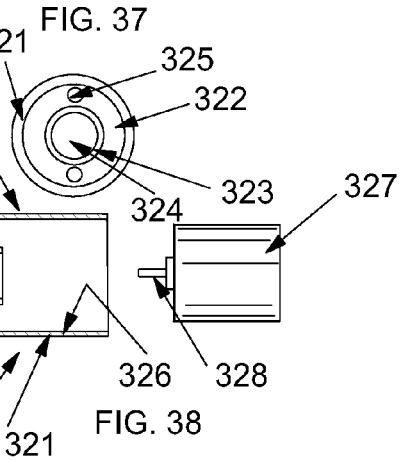
FIG. 37
FIG. 38

SWEEPER WITH SWEEPING ELEMENTS

BACKGROUND OF THE INVENTION

The present invention relates to rotationally driven sweepers, especially those which are battery operated and whose rotated elements contact a floor surface.

Electric-powered sweepers with extensions from a rotating, cylindrical drum are routinely used to sweep dirt particles directly from a floor surface into a closed container while traversing a floor area. The extensions of such sweepers must contact a floor or rug surface and make a brushing impact with that surface with sufficient force to effectively cause the elevation and forceful trajectory of all dirt and waste particles the extension encounters. Substantial electrical power is required in prior art designs to accomplish this function. Well known prior art designs of sweepers and vacuum cleaners mount longitudinal rows of flexible, straight bristles on a cylinder rotated at high speed. The bristle ends must impact upon and sweep a floor surface at high speed. While the bristle structure is beneficial in that fabrication has become inexpensive, the straight bristle design is impractical for battery powered sweepers due to the relatively high power requirements needed to cause bristle rotation and deformation on impact with a floor surface.

Although self-contained battery powered electric vacuum cleaners are well known, they can only be used for small area cleaning because they have too little stored power to clean any significant area due to their inherent high power requirements. There is a need for a sweeper design which accomplishes effective sweeping with low power requirements.

SUMMARY OF THE INVENTION

The present invention is a sweeper design incorporating multiple rotation elements mounted adjacently in an rotationally offset sequence on a common driven axle. Each rotation element comprises a central shaft support from which extends lightweight extension arms that have laterally elongated spatulate paddles at their ends. The extension arms are curved so that in operation a terminal edge of each paddle lags the rest of the paddle surface in approaching and sweeping across the floor surface and is quite easily deflected upward from a floor surface. This angular approach of the paddles to the sweeping surface reduces energy consumption while preserving effective sweeping of the surface.

The rotational elements are not longitudinally aligned along their rotation axis. Instead, the arms of the rotational elements are axially staggered apart from one another so that each paddle leads and/or lags a paddle of an adjacent rotation element while in operation. In addition, longitudinal parts of a lagging paddle rotationally overlap at least part of the rotational path of a leading paddle which rotationally leads the lagging paddle. Rotational overlap provides for sweeping impact for a dirt particle on the lagging paddle that may have escaped upward sweeping motion of the leading paddle.

In a preferred embodiment, multiple rotation elements are arranged on a rotation support shaft so that the sequence of adjacent rotation elements from each end toward a center of the shaft provides for leading to lagging spatulate paddles

BRIEF DESCRIPTION OF THE DRAWINGS

FIGS. 25, 26, 27, 28 and 29 are respectively top, front, side, rear and side cutaway views of a top waste receptacle housing.

FIGS. 30, 31 and 32 are respectively bottom, front and side views of the assembled top and bottom waste receptacle housings.

FIG. 33 is a side view of a compact embodiment of the invention.

FIG. 34 is a front view of an over housing of the device of FIG. 33.

FIGS. 35 and 36 are, respectively, side and front views of enlarged bore sweeper elements for the device of FIG. 33.

FIG. 37 is an end view of a motor connector cylinder adapted to engage a cylindrical electric motor.

FIG. 38 is a side cutaway view of the cylinder of FIG. 37 where a small electric motor is shown separated from its connected position with said cylinder.

DETAILED DESCRIPTION OF THE INVENTION

The invention is now discussed with reference to the figures.

Figure 1:
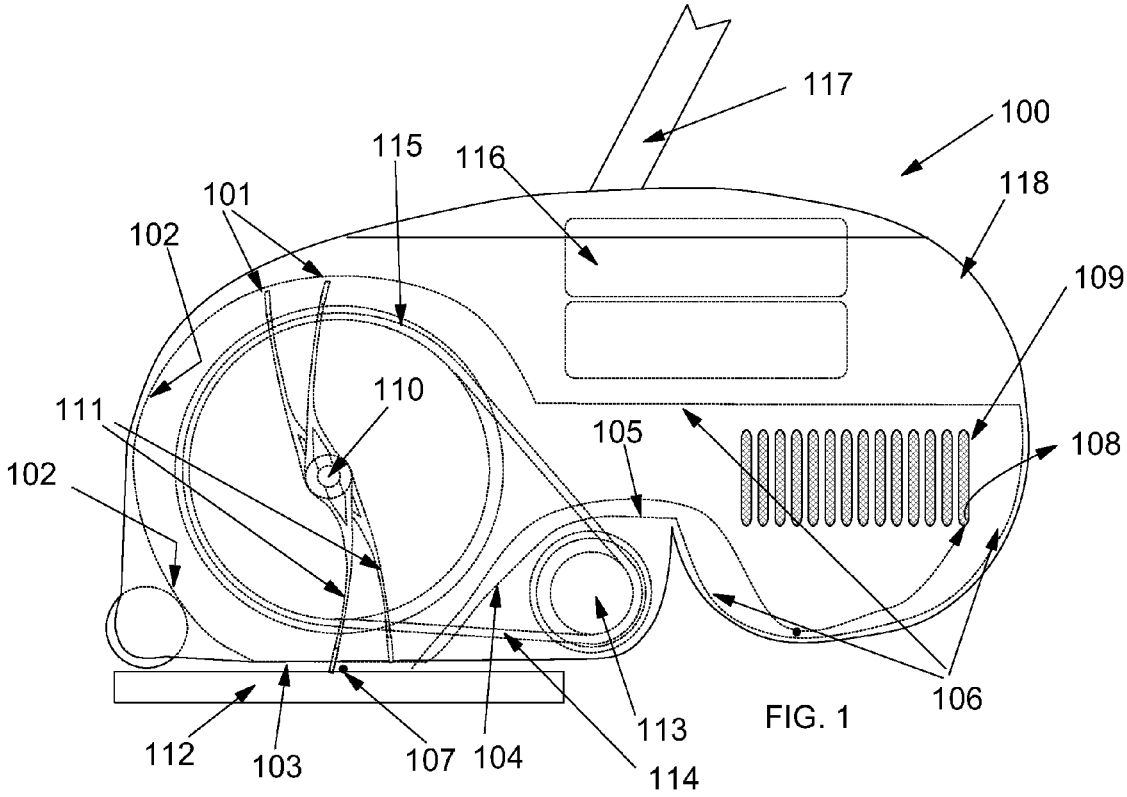
FIG. 1 is a side view of an embodiment of the invention sweeper showing rotation elements and internal components in broken lines.

The invention sweeper 100 shown in FIG. 1 comprises rotation elements 101 fixed rotationally relative to each other on drive shaft 110 so that spatulate paddles at the end of extensions 111 are rotated in a counterclockwise manner. The spatulate paddles comprise terminal edges that sweep along the internal cylindrical surface of housing 102 and through the rectangular opening 103 to sweep upon floor 112. The spatulate paddle in that floor sweeping action impacts upon particle 107 resting on floor 112, causing it to be lifted and swept up along ramp 104 to be delivered into passage 105 and deposited in receiver cavity 106 along path 108, where air compressed and swept into the passage 105 is expelled through screened vent 108 while leaving behind particle 107 in cavity 106. Motor 113 is shown in broken lines connected by belt 114 to wheel 115. Wheel 115 is in turn connected to drive shaft 110 to cause rotation of drive shaft 110 and thereby rotation of rotation elements 110. Batteries 116 are shown secured within external housing 118 to power motor 113. A pivoted handle 117 is shown attached to housing 118 so that sweeper 100 may be moved back and forth along floor 112 to accomplish a sweeping of that surface.

Figure 2:
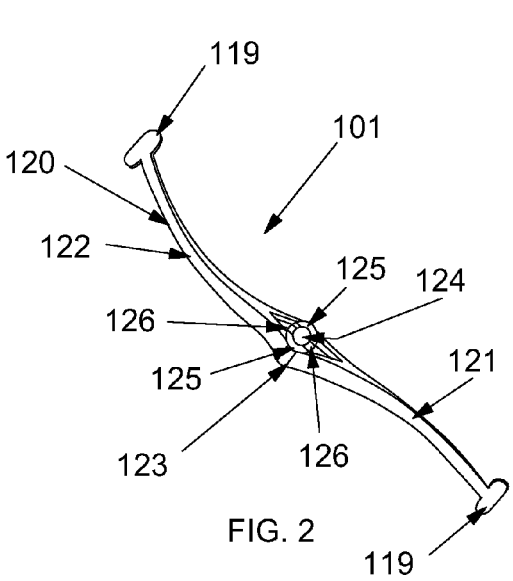
FIG. 2 is a side perspective view of a rotation element.
Figure 3:
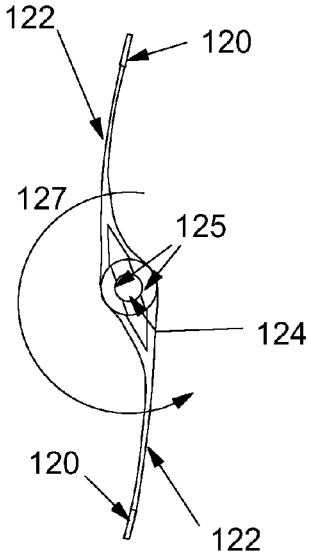
FIG. 3 is a side view of a rotation element.
Figure 4:
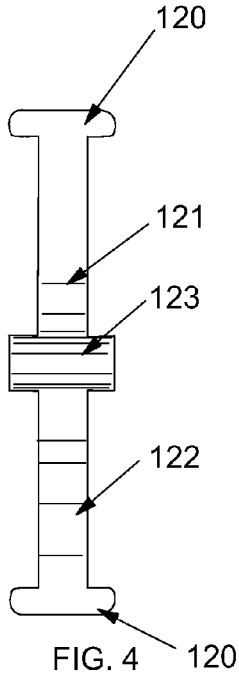
FIG. 4 is a front view of a rotation element.

FIGS. 2, 3 and 4 show rotation element 101 comprising a hub 123 with a bore 124 through which drive shaft 110 is inserted for driving support of element 101. From hub 123 extend extensions 120, each comprising a concave side 121 and convex side 122. At distal and terminal ends of extensions 120 are fixed a spatulate paddle 119 extending laterally to the extensions to form an oval or rectangular sweeping surface with substantially greater lateral sweeping surface area than the convex side 122 of extension 120. In a preferred embodiment, the spatulate paddle 119 comprises a flat piece with a width of from 5 to 15 millimeters, height of from 2 to 5 millimeters, and a thickness of from 0.1 to 1.0 millimeters. The frontal surface of paddles 119 are shown to be continuous with the convex side 122, but are substantially wider than the surfaces of convex sides 122. This structure provides for substantial sweeping surfaces at terminal ends of extensions 120 where the most significant part of sweeping occurs. This structure also reduces the surface area of convex sides 122 and thereby reduces power requirements for their rotation commensurate with their less significant sweeping capability.

Hub 123 comprises interlocking lugs 125 which define slot 124. Adjacent rotation elements 120 have are fitted together so that their lugs 125 and slots 124 cause adjacent rotation elements to be maintained in rotational separation by from about ten degrees to forty five degrees, although more preferably from about fifteen degrees to about thirty degrees. This rotational alignment along drive shaft 110 controls the arc distance between leading and lagging spatulate paddles. Reducing the rotational separation of the rotation elements 120 improves single pass sweeping efficiency at a higher power cost, while increasing that separation reduces the total number of rotational elements at the cost of reducing single pass sweeping efficiency.

Figure 5:
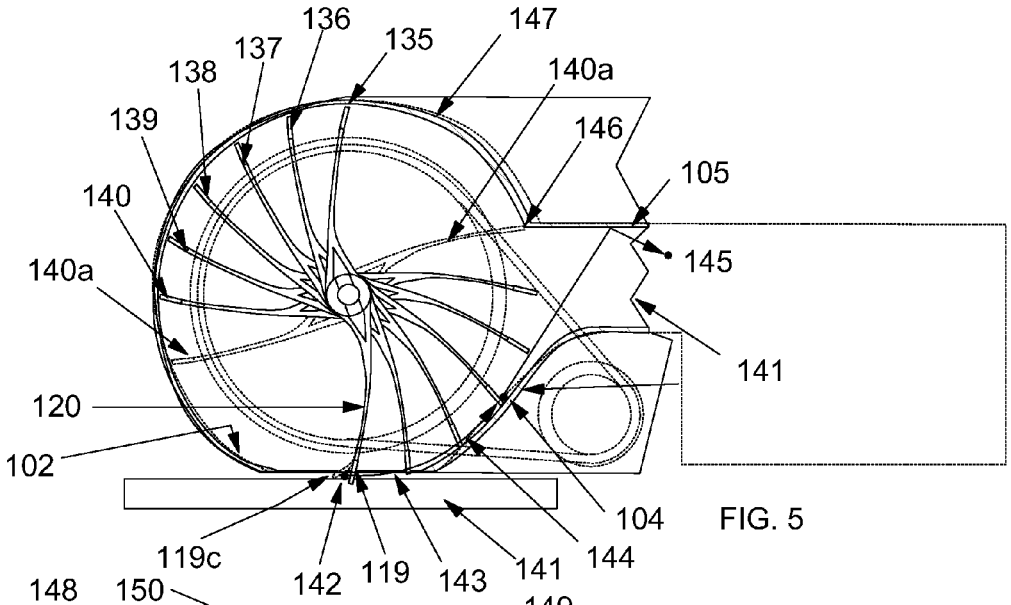
FIG. 5 is a side cutaway view of a frontal portion of the sweeper of FIG. 1.
Figure 6:
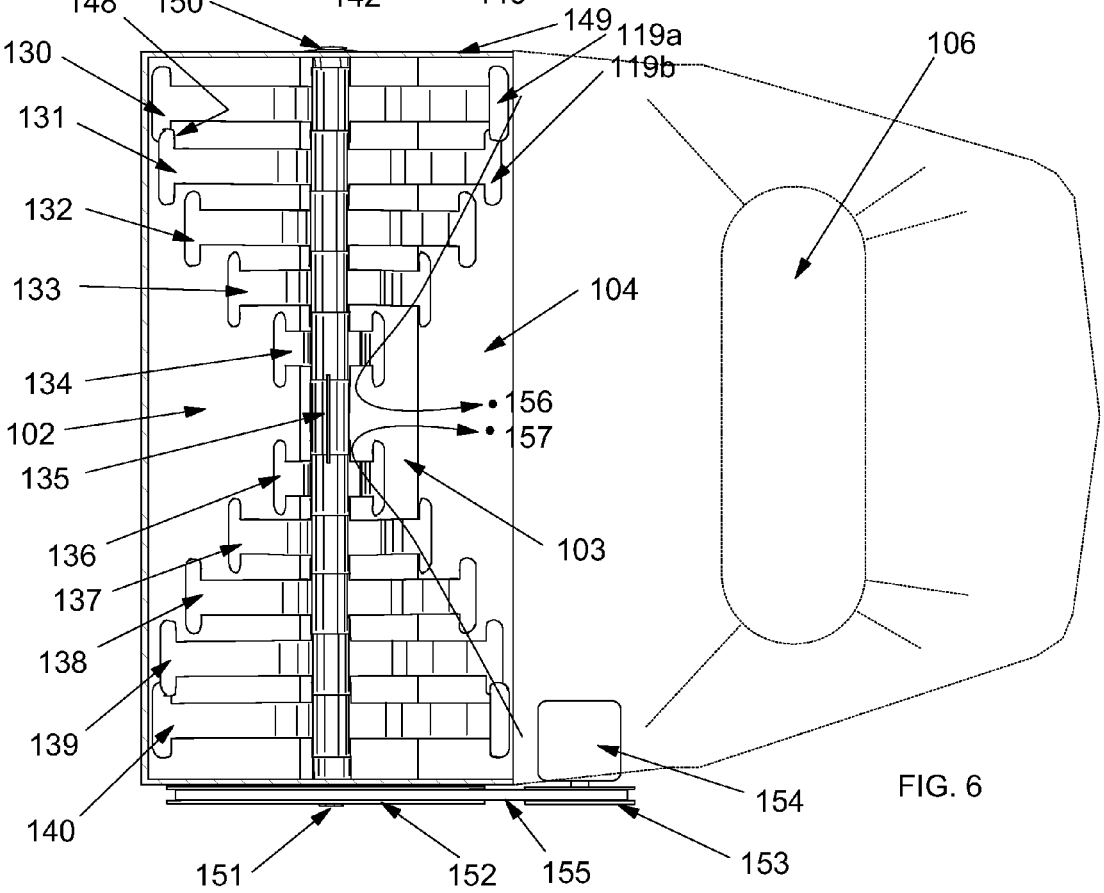
FIG. 6 is a top cutaway view of a frontal portion of the sweeper of FIG. 1 without side housings.

FIGS. 5 and 6 show side and top cutaway views of a preferred form of the invention sweeper. Increasing or decreasing the number of rotation elements is optional. Rotation elements 130 to 135 are rotationally separated by about over 20 degrees so that, for example, paddle 119*a* rotationally overlaps the rotational path of 119*b* by at least about 1-2 millimeters so that particle 156 can be passed along the ramp 104 ends of elements 130 to 135 to be finally lifted up ramp 104 to passage 105. Similarly, rotation elements 140 to 135 are rotationally separated by about over 20 degrees so that, for example, their spatulate paddles rotationally overlap those of adjacent spatulate paddles by at least about 1-2 millimeters so that particle 157 can be passed along the ramp 104 ends of elements 140 to 135 to be finally lifted up ramp 104 to passage 105. The particular orientation of the ramp 104 ends of rotation elements 130 to 140 form a cylindrical V-shape sweeping formation with a lagging vertex at the ramp 104 paddle of element 135. This sweeping formation provides for successive V-shaped sweeping formations brushing against the inside cylindrical surface of housing 102, across floor 141 by emerging through opening 103, brushing up ramp 104, across the opening of passage 105, and again into contact with the inside cylindrical surface of housing 102. It can be appreciated that particle 142 on floor 141 is impacted by the flexed spatulate paddle 119*c*, shown as a broken line representation of the unflexed paddle 119 in FIG. 5. As paddle 119*a* is rotated up toward ramp 104, it again straightens after its flexing contact with floor 141. Particle 142 is lifted and swept up ramp 104 to location 144, where it is typically lifted up to impact a top part of passage 105 to rebound to location 145, from whence it is deposited into the receiver cavity 106. Motor 154 is shown driving pulley wheel 153, which in turn drives belt 155 to drive pulley wheel 152 and thereby connect to drive shaft 110 at bolted connector 151.

FIGS. 5 and 6 show that providing two extensions with spatulate paddles per each rotation element creates two of the above V-shaped sweeping formations moving along the surfaces of housing 102 and ramp 104 and across opening 103 and the opening of passage 105. It is well shown that at all times spatulate paddles 119 are at all times substantially angled forward at less than normal to any surface across which they may sweep. The loss of sweeping efficiency by so inclining the spatulate paddles is more than compensated by rotation at a relatively high speed and rotationally overlapping paths. Sweeping efficiency is quite high at a reduced power consumption. Each element 120 preferably has a length of from about 40 to 70 millimeters and a weight of from 1 to 3 grams. A preferred composition is polyolefin polymers such as polyethylene.

Figure 7:
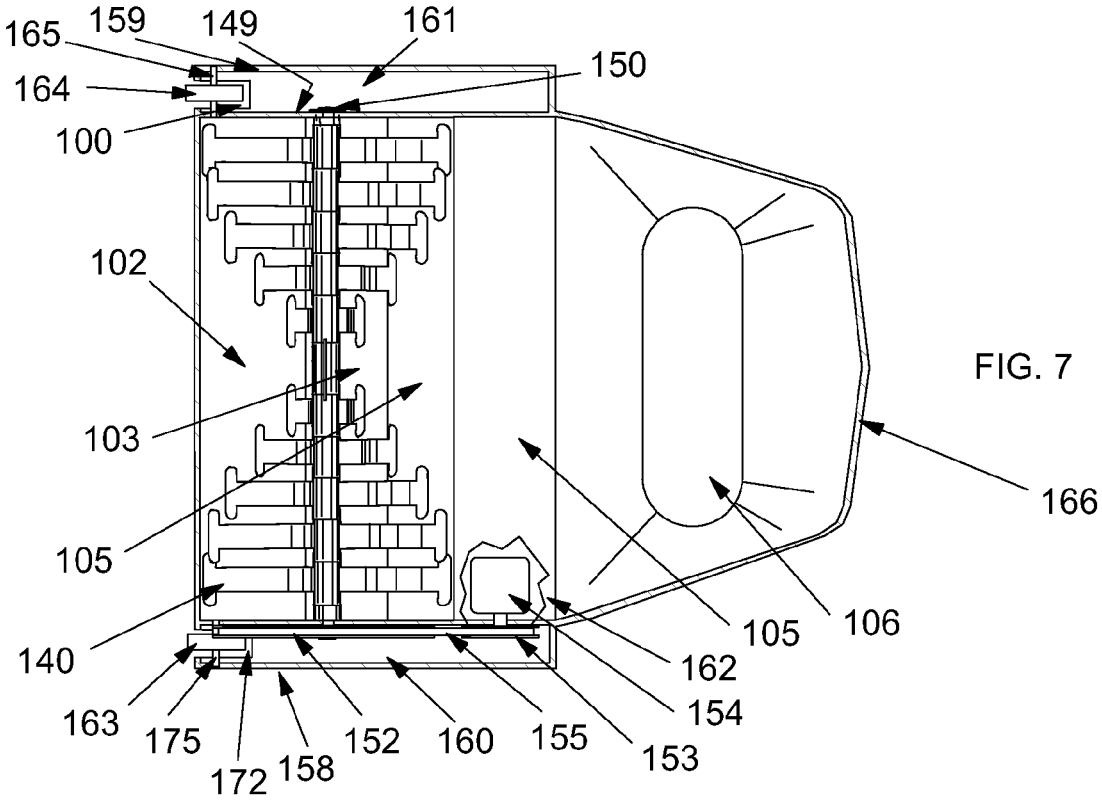
FIG. 7 is a top cutaway view of a frontal portion of the sweeper of FIG. 1 with side housings.

FIG. 7 shows a top and cutaway view of additional side housings for the wheels 152 and 153 and roller wheels 163 and 164. Wheels 163 and 164 extend through openings 172 and 174 respectively of housings 158 (defining cavity 106) and 159 (defining cavity 161). Axles 175 and 165 extend into their associated housings to support wheels 163 and 164 to provide rolling support of the sweeper along a swept floor. A cutaway section 162 shows that motor 154 is secured to an endwall of housing 102 so that its drive shaft 168 (FIG. 8) is rotatable to drive pulley wheel 153.

Figure 8:
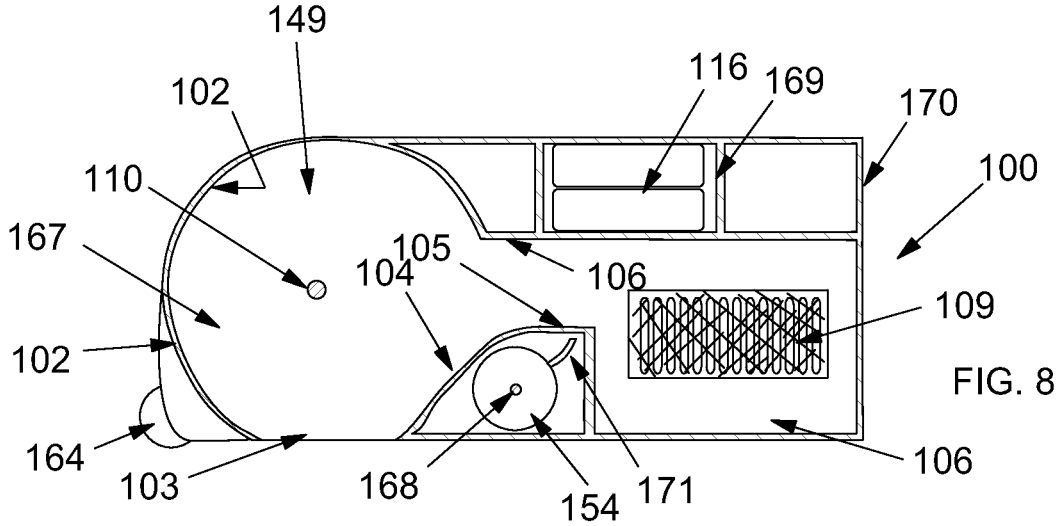
FIG. 8 is a side cutaway view of the internal housing for rotation elements (not shown) of the device of FIG. 7.

FIG. 8 shows that housing 102 comprises a substantially cylindrical inside surface at a uniform distance from drive shaft 110 so that spatulate paddles of the rotation elements will lightly brush against said surface. Receiver cavity 106 is defined by a housing 170 supporting a filtered or screened vent 109 to the outside of said housing. Internal extensions of housing 170 provide effective support for drive batteries 116 between walls 169. Motor 154 is shown secured to and underlying a housing formed underneath ramp 104 with electrical wire 173.

Figure 9:
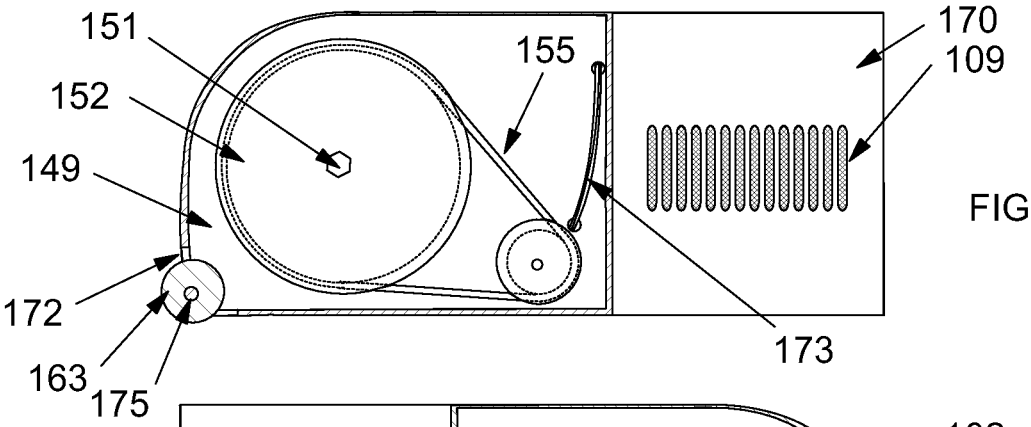
FIG. 9 is a side cutaway view of the left side housing of the device of FIG. 7.

FIG. 9 shows that wire 173 extends to cavity 160 and upward to connect with drive batteries.

Figure 10:
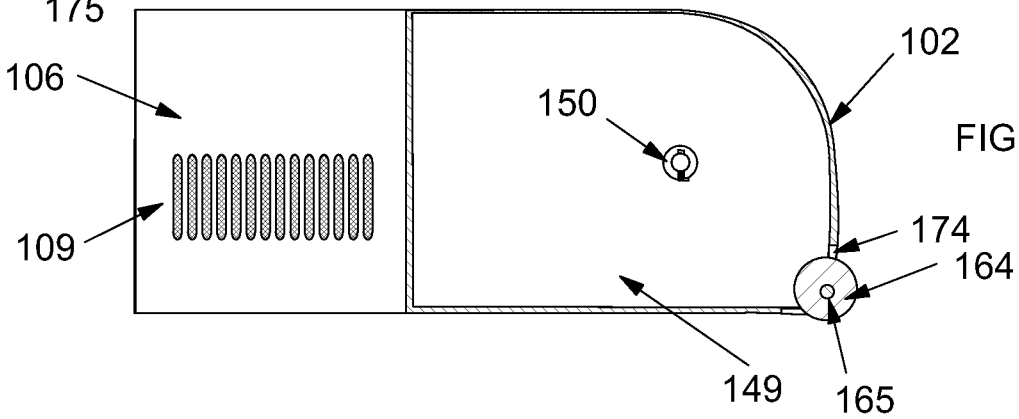
FIG. 10 is a side cutaway view of the right side housing of the device of FIG. 7.

FIG. 10 shows a connector 150 fixes an end of drive shaft 110 to an endwall of housing 102.

FIGS. 11 through 32 describe an alternate embodiment of the invention sweeper.

Figure 11:
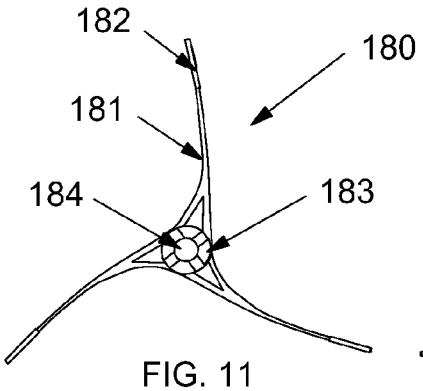
FIGS. 11, 12, and 13 are respectively right, left and front views of a rotation element having three arms.
Figure 12:
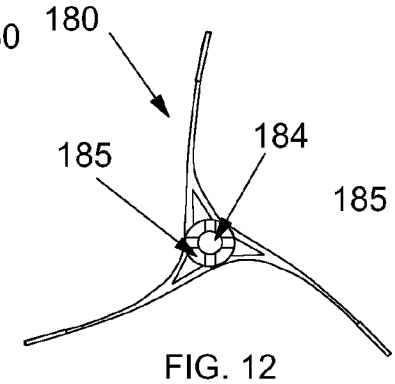
Figure 13:
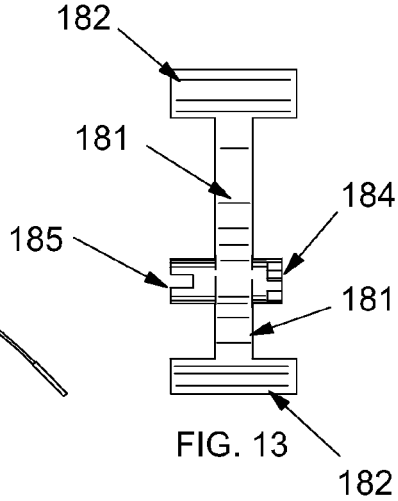
Figure 14:
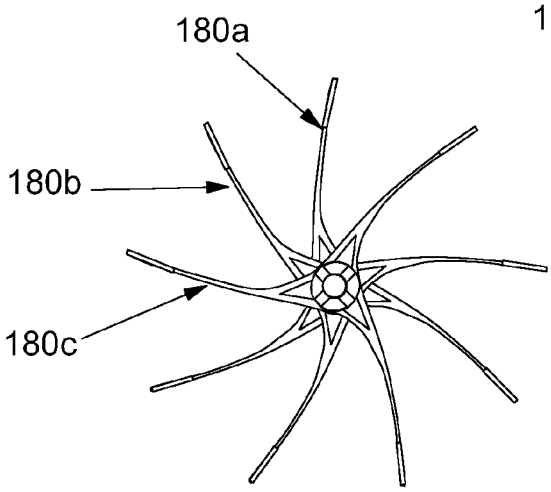
FIG. 14 is a side view of three rotation elements of FIG. 11 interlocked in a side by side alignment.
Figure 15:
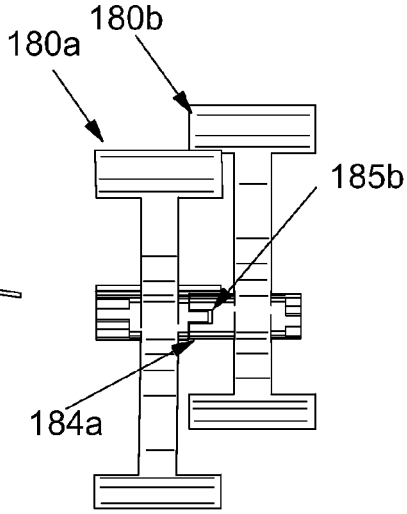
FIG. 15 is a front view of two of the rotation elements of FIG. 11 interlocked for rotation about a drive axle.

FIGS. 11, 12, and 13 are respectively right, left and front views of a rotation element 180 having three arms 181, wherein each arm terminates in spatulate paddle 182 and connected to central connector defining an axle bore 183 and having right side articulations 184 and left side articulations 185 adapted to interlock with each other when elements 180*a* and 180*b* are arranged on a supporting axle, as shown in FIGS. 14 and 15. Element 180*c* is shown in FIG. 14, thereby defining an operational unit for the sweeper with paddles 182 axially separated by about 30 degrees. Paddles 182 in FIG. 15 show rotational overlap when said elements rotate.

Figure 16:
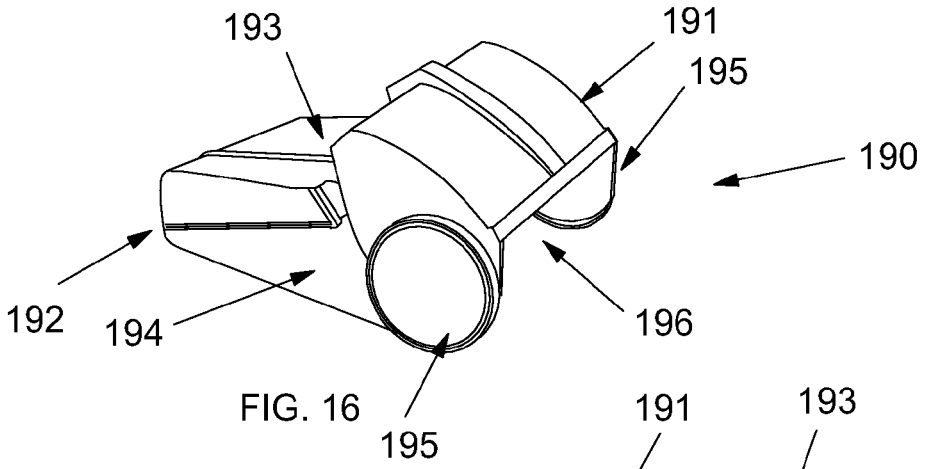
FIGS. 16, 17 and 18 are respectively front, top perspective, rear, top perspective and side views of a second embodiment of the invention sweeper.
Figure 17:
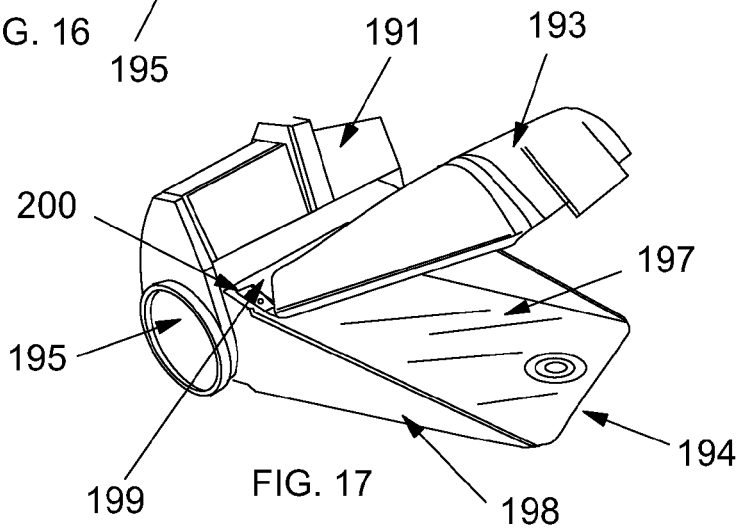
Figure 18:
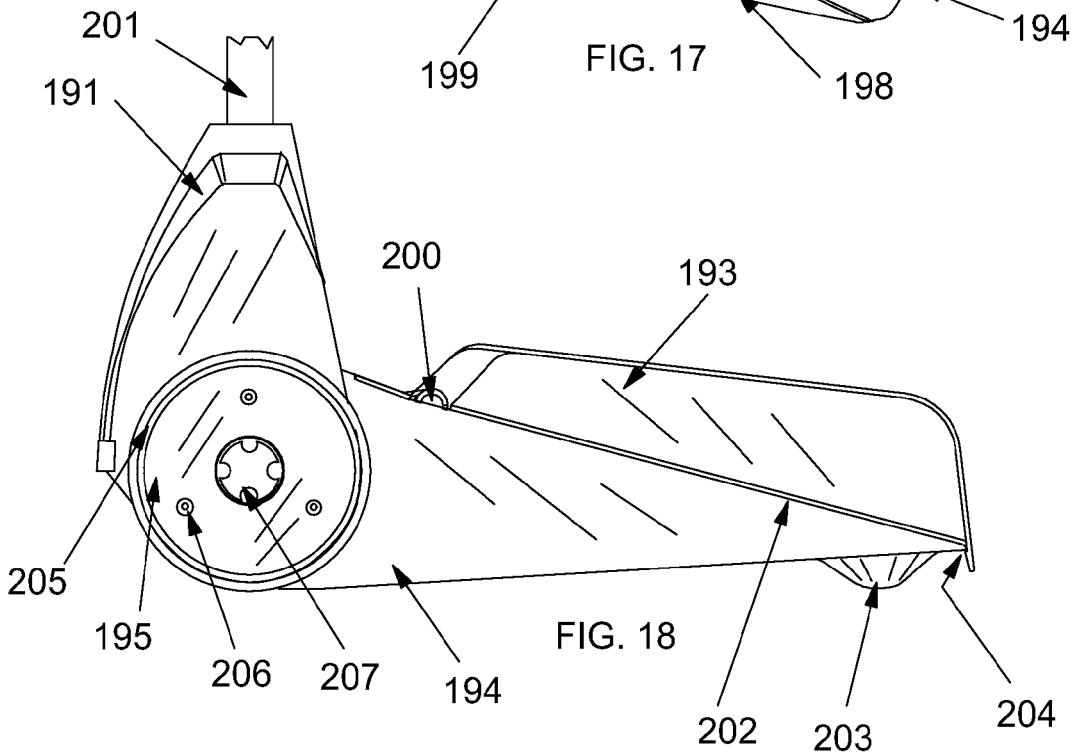

FIGS. 16, 17 and 18 are respectively front, top perspective, rear, top perspective and side views of a second embodiment 190 of the invention sweeper. Generally, a front housing 191 supports an axle (not shown) that connects and supports wheels 195 exterior to housing 191 and elements 180 (not shown) in the space 196. A rear waste receptacle 192 is comprised of top housing 193 and bottom housing 194. Top housing 193 is connected by hinges 200 to bottom housing 194 at an upper plate 199 of bottom housing 199. Bottom housing 194 is comprised of a floor 197 and sidewalls 198, whose upper edges are adapted to mate to lower edges of sidewalls 221 of top housing 193. Upper plate 199 connects frontal ends of sidewalls 198. FIG. 17 shows top housing 193 rotated into an open position for disposal of waste swept into the space defined when the top housing 193 and bottom housing 194 are latched shut by latch 104, as shown in FIG. 18. FIG. 18 shows that handle 201 (in broken view) connects with front housing 191 at an upper end. Upper housing 191 and receptacle 192 are secured to and are rotatable about axle means 207, which axle means also secure wheels 195 outside an upper housing 191 so that sweeper 190 can be moved across a swept floor. Interface 202 shows mating and closure edges of top housing 193 and bottom housing 194, whereby receptacle 192 is in a closed position and can receive and retain waste particles swept into in by action of elements 180.

Figure 19:
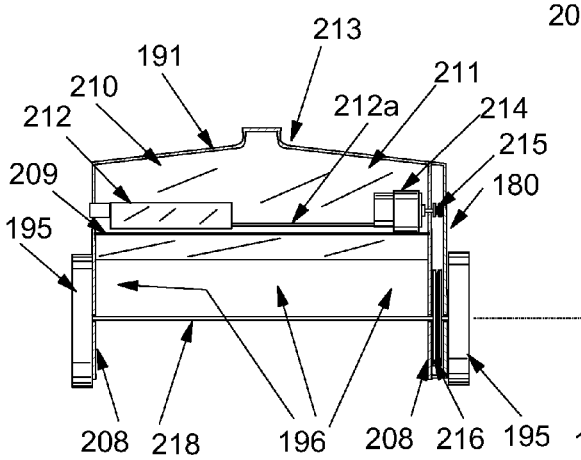
FIG. 19 is a front, cutaway view of a rotation element housing of the sweeper of FIG. 18.

FIG. 19 is a front, cutaway view of a rotation element housing of the sweeper 190 showing interior structure and operational parts. Side walls 208 extend from a position relatively close to a supporting floor for the sweeper up to a roof 213, which, with front and rear walls 211, define an interior space divided by plate 209. Plate 209 supports rechargeable battery 212 and motor 214, which are electrically connected via wires 212*a*. Battery 212 comprises external access to recharge plug and an on/off switch with which a user may turn motor 214 on or off. Motor 214 comprises an lateral extension through side wall 208 into a space defined between side housing 217 and an outside surface of sidewall 208, providing protective enclosure for two belt pulley wheels 215 and 216, where pulley wheel 215 is connected with said extension of motor 214. Motor 214 is adapted to cause rotation of pulley wheel 215 so that pulley wheel 216 rotates by belt connection thereto. Rotation of pulley wheel 216 causes effective, sweeping rotation of elements 180 (as in FIGS. 11, 12 and 13) in space 196 about axle 218 by nature of interlocking connections between said elements 180 and an interlocking connection between an element 180 located adjacent to pulley wheel 216 but separated from it by sidewall 208. Pulley wheel 216 is aligned for connection via belt (not shown) with pulley wheel 215 and is further connected to axle 218. Axle 218 extends through and is supported by sidewalls 208 and side housing 217.

Figure 20:
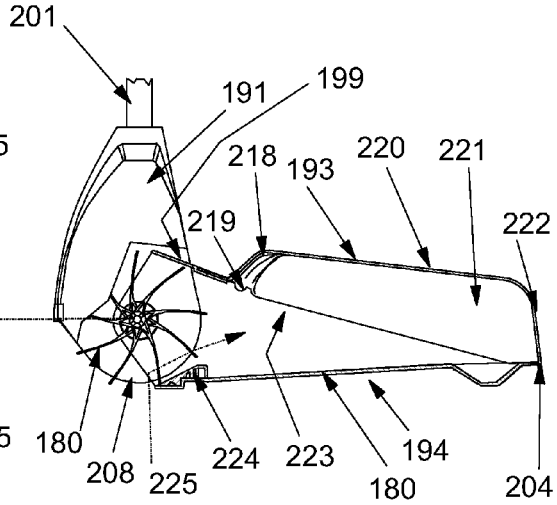
FIG. 20 is a side, cutaway view of the rotation element housing and waste receptacle housings of the sweeper of FIG. 18.

FIG. 20 is a side, cutaway view of the front housing 191 and waste receptacle 192. Sidewall 208 is shown in broken away view showing the alignment of interlocked elements 180 on axle 218. The lowest most paddles of elements 180, when rotated, sweep particles off a supporting floor along path 225 into the space defined between top housing 193 and bottom housing 194. A rubber wedge element 224 is secured to and extends along the width of a bottom, front edge of floor 197 to provide and upward ramp for launching swept up particles into said space between housings 193 and 194. Upper plate 199 is arranged so that rotating paddles of elements 180 extend close to an under surface thereof in rotating operation. In this cutaway view, top housing 193 is shown comprising sidewalls 221 and top 220, the rear portions of which are boxed in by end plate 222, extending down from which is latch 204. Front plate 218 boxes in front portions of sidewalls 221 and top 220. Lateral extensions from aspect 219 support hinge means.

Figure 21:
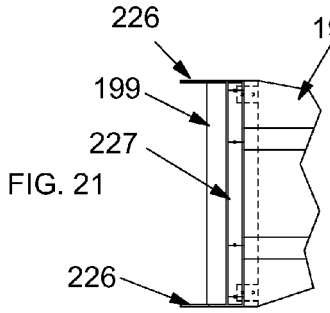
FIGS. 21, 22, 23 and 24 are respectively bottom cutaway, top, front and rear views of a bottom waste receptacle housing.
Figure 22:
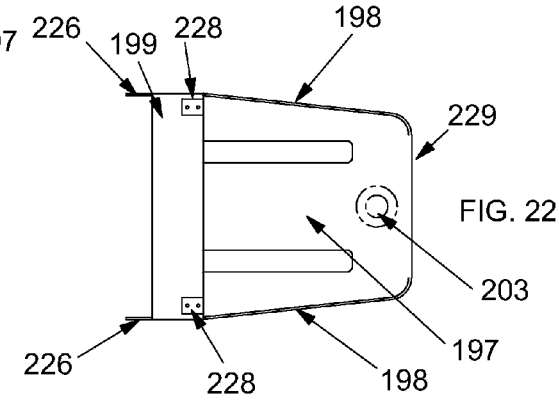
Figure 23:
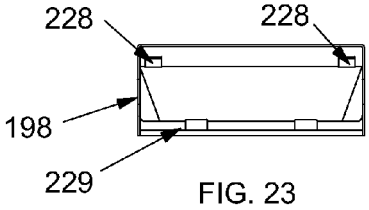
Figure 24:
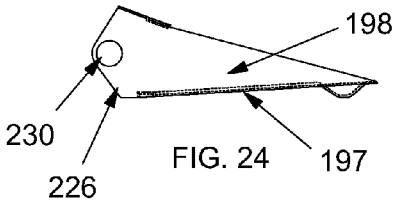

FIGS. 21, 22, 23 and 24 are respectively bottom cutaway, top, front and rear views of the bottom housing 194. FIG. 21 shows section 227 upon which is secured wedge element 224. Hole 230 provides support for axle means by which waste receptacle 192 is rotatable with respect to the front housing 191. Rear edge 229 is adapted to receive a latching engagement with latch 204 (FIG. 20).

FIGS. 25, 26, 27, 28 and 29 are respectively top, front, side, rear and side cutaway views of the top housing 193. Cutout portions of top 220, sidewalls 221 and end plate 218 provide space for extension of pins 232 to form an axis for rotation of top housing with respect to bottom housing 194. FIG. 27 shows edges 234 which are adapted to mate to top edges of sidewalls of the bottom housing when the waste receptacle is in the closed position. Downward extensions 235 are adapted to lie just within said sidewalls of the bottom housing.

FIGS. 30, 31 and 32 are respectively bottom, front and side views of the assembled top housing 193 and bottom housing 194. FIGS. 30 and 32 show top and side views of loop 237 which secures extension 232 to upper plate 199 so that the top housing can be opened and closed by rotation about the axis formed by pins 232.

With the exception of electrical components, the invention sweeper may be formed from low cost polymer components and housings. The invention sweeper will have two or more rotation elements.

As shown in FIGS. 33 through 42, the following is a description of a compact embodiment of the invention. FIG. 33 is a side view of a compact embodiment device 300 comprising a hand pushed sweeper with handle 301 (shown in part) connected with battery/controller housing 302, which extends down via two support arms 333 though slots 363 defined in an upper most part of a front portion 304 of over housing 303. Over housing 303 is a shell defining an internal cavity generally enclosing rotating sweeper elements and a waste receptacle that receives swept up waste particles. Front portion 304 comprises rotatable connections for two wheels 311 that permit device 300 to be pushed forward and back for sweeping action accomplishing the objects of the invention. Front portion 304 is also provided with a width-wise rectangular opening 310 adapted to provide allow effective contact between the rotating paddle or spatulate ends of sweeper elements 314 and a floor surface to be swept by device 300. Front portion 304 extends rearward to upper rear portion 305 and lower rear portion 306, which terminate in a downward sloping opening adapted to be releasably sealed during operation by rear door 307 hinged at an upper end via hinge 308 to upper rear portion 305. Door 307 is provided with latch 309 so that it may connected with lower rear portion 306 during sweeping operation and opened for removal of waste particles. FIG. 34 shows that wheel attachment extensions 313 are provided laterally from front portion 304 for attachment of wheels 311 (not shown). A waste receptacle part of device 300 comprises an internal cavity defined by inside surfaces of portions 305 and 306 and door 307.

FIGS. 35 and 36 are, respectively, side and front views of enlarged bore sweeper element 314, which are similar to the above described sweeper elements, except that a bore 316 defined by cylindrical support 315 is substantially increased in this embodiment. Arms 318 extend from connection 317 to a spatulate end 319 so that in rotation of sweeper element 314 causes a distal edge of end 319 to contact a swept floor surface to lift waste particles therefrom and into the waste receptacle part of device 300.

FIG. 37 is an end view of a motor connector cylinder 320 adapted to engage a drive shaft of an electric motor. Cylinder 320 comprises an outer cylindrical wall 321 closed at one end by plate 322, which defines screw holes for screw connection with another rotating cylindrical part. Plate 322 comprises a central connector section 323, which is adapted to securely connect with a drive shaft of an electrical motor. FIG. 38 shows cylinder 320 in cross section with a small, battery driven electric motor 327 with a drive shaft 328 aligned to be connected with central connector section 323. The combination of motor 327 and cylinder 320 are critical to the operation of the present embodiment.

Figure 39:
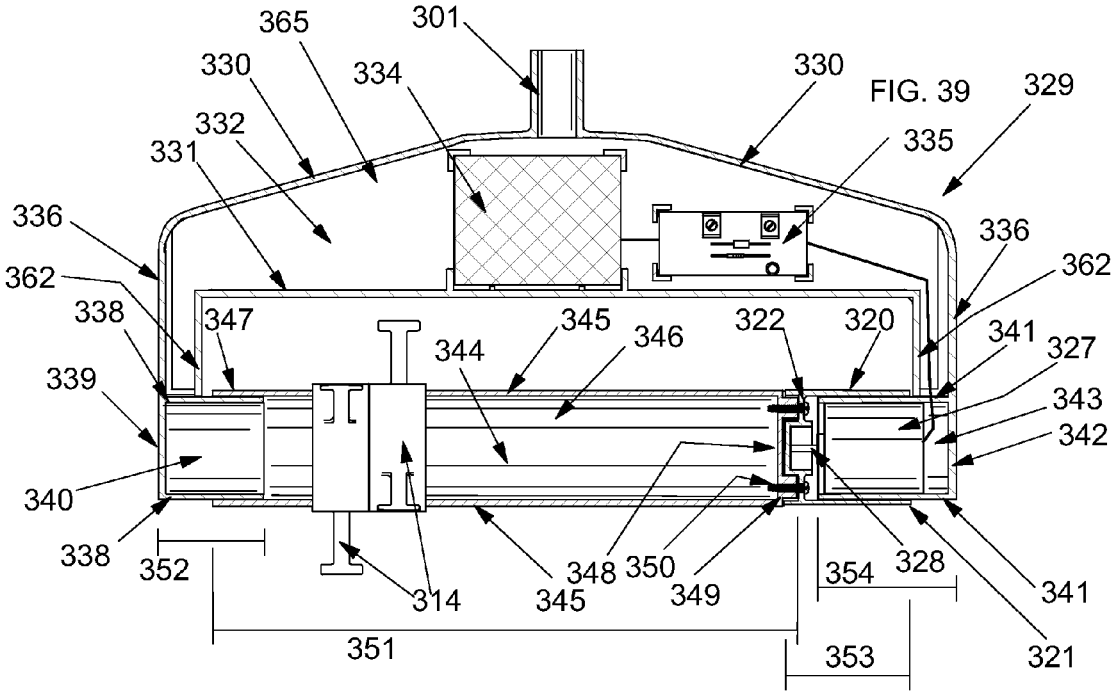
FIG. 39 is a front, cutaway view of a battery and controller housing connected by two downward arms to a rotating support for sweeper elements of FIG. 36 driven by the motor connected with motor connector cylinder of FIG. 38.

FIG. 39 is a front, cutaway view of a battery and controller housing 302 comprising top wall 330 which extends downward to front (not shown) and rear walls 365 and side walls 336, which in turn are connected by floor wall 331, all of which define an internal cavity 332. Cavity 332 provides a small, compact space for location of battery 334 and controller 335, which are secured to walls 365. Controller 335 comprises switches extending to buttons or other user interface so that a user may switch device 300 on and off, i.e., battery 334 is connected by electrical connections through controller 335 to motor 327 to accomplish powering and on-off control of motor 327. Downward arms 362 extend down from side walls 336 and floor wall 331 to support housing 302 above front portion 304 (as in FIG. 33). Side walls 336 extend further downward to floor plates 339 and 342 on opposing downward arms 362. From floor plate 339 extends cylinder 338 with an internal, bore 340 open at one end, which is aligned with and directed toward an identically dimensioned cylinder 341 with bore 343, which cylinder 341 extends from floor plate 342. By way of assembly description, floor plates 339 and 342 are adapted to be secured by a rotatable connection (such as a bolt or rivet 361 as in FIG. 33) at a common axial location of cylinders 338 and 341 to left and right sides of front portion 304 (as in FIGS. 33 and 34). In this way, the assembly of FIG. 39 may be supported within an internal cavity of front portion 304, whereby a user moving handle 301 forward and back causes the assembly of FIG. 39 to rotate about axes of cylinders 338 and 341 with respect to front portion 304.

Now again referring to the assembly of FIG. 39, motor 327 is lodged securely within bore 343 of cylinder 341 with drive shaft 328 extending beyond an opening of cylinder 341. Motor connector cylinder 320 is located in closely fitting but slidable relationship about the outside surface of cylinder 341, whereby drive shaft 328 of motor 327 is securely connected to cylinder 320 so that rotation of drive shaft 328 of motor 327 causes cylinder 320 to easily rotate as well. A sweeper element support cylinder 344 comprises a cylindrical wall 345 defining a bore 346, open an end 347 but closed by plate 348 at end 349. One end 347 of cylinder 344 is in a closely fitting but slidable relationship about the outside surface of cylinder 338. End 349 comprises extensions from plate 348 to receive ends of screws 350, which connect motor connector cylinder 320 to cylinder 344, thereby providing effective transmission of rotational drive force of motor 327 to the combined lengths 351 and 353, respectively, of cylinders 320 and 344. Cylinders 338 and 341 have, respectively, lengths 352 and 354 to form a fixed rotational support for the connected cylinders 320 and 344. Motor 327 is thereby effectively located within one end of said fixed rotational support, reducing overall number of parts and size of housing parts as compared with other embodiments of the invention.

Figure 40:
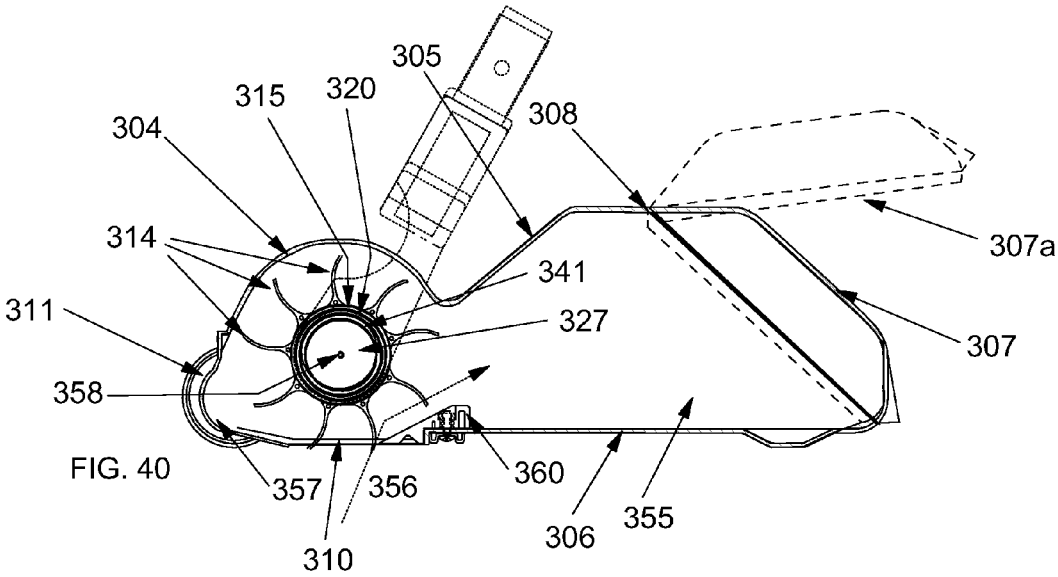
FIG. 40 is a side cutaway view of the device of FIG. 33 without the battery and controller housing and downward arms of FIG. 39.

Referring further to FIG. 39, sweeper elements 314 are closely fitting and fixed relationship with respect to each other (side by side and interlocking) and with respect to the outside surface of cylinders 314 and 320. Representative sweeper elements 314 are shown in FIG. 39, however it is intended that sweeper elements 314 extend along the outside surface length of cylinders 320 and 344. Operation of the present embodiment is initiated by a user pressing a button or switch at controller 335, which in turn connects battery 334 with motor 327. Motor 327, fixed inside cylinder 341, causes drive shaft 328 to rotate relative to cylinder 341. Rotation of drive shaft 328 causes cylinders 320 and 344 to rotate in the same direction, which in turn causes sweeper elements 314 to rotation and sweep a floor surface. A clearance between cylinders 320 and 344 and floor plate 331 are provided for rotation and sweeper elements 314 and enclosure of the sweeper elements by front portion 304 (FIGS. 33 and 40). FIG. 40 shows a broken line position 307*a* of door 307 when it is in the open position. FIG. 40 also shows an end view with floor plate 342 and side wall 336 cut away to expose ends of motor 327, cylinder 341, cylinder 320, and cylindrical support 315 of sweeper element 314, where the ends of sweeper elements 314 are shown as being arranged to rotate in close association with a top part of front portion 304 and extend out from opening 310 to contact a swept floor surface, such that ramp 360 assists swept particles to follow generally path 356 in waste receptacle 355. Waste receptacle 355 is defined by portions 305 and 306 and door 307 to contain swirling and swept up waste particles during operation.

Figure 41:
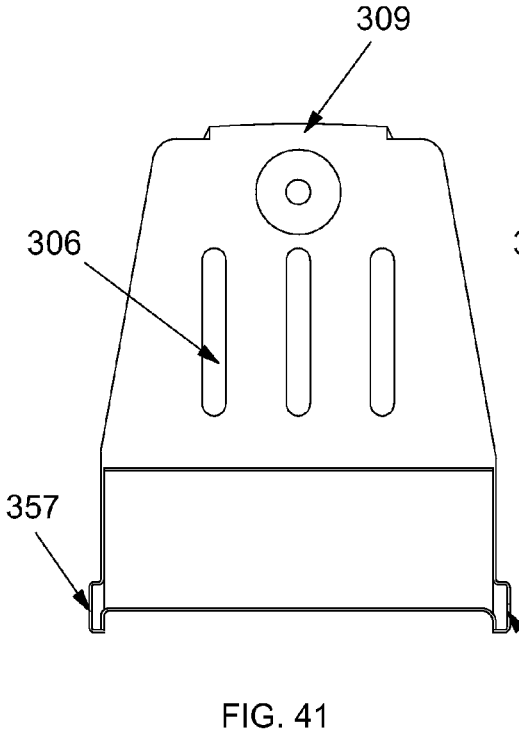
FIG. 41 is a bottom view of the device of FIG. 33.
Figure 42:
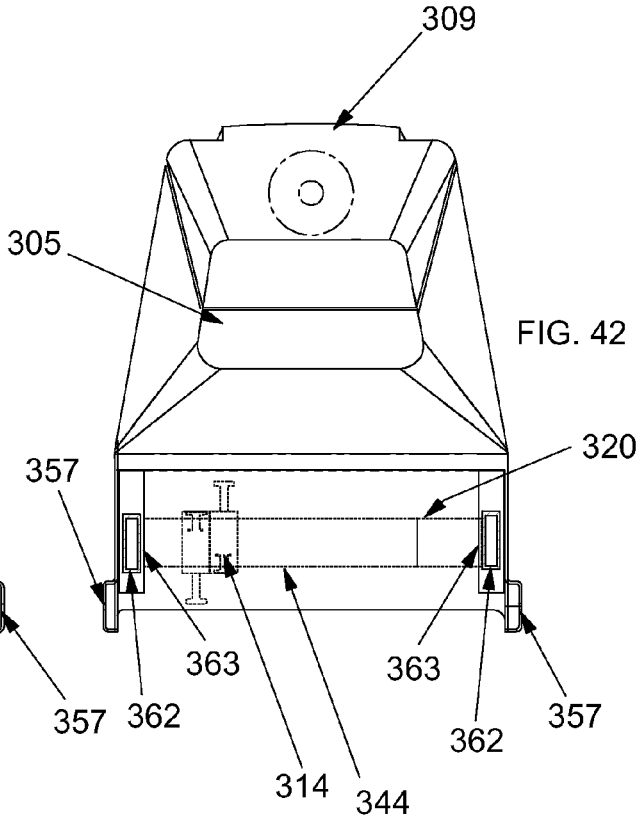
FIG. 42 is a top view of the device of FIG. 33 without the battery and controller housing and at a cross section downward arms of FIG. 39.

FIG. 41 is a bottom view of device 300 and FIG. 42 is a top view thereof without the battery and controller housing and at a cross section downward arms 362 presenting through slots 363.

In an alternate form of this embodiment, the assembly of FIG. 39 may be fixed and non-rotatable with respect to front portion 304 (FIG. 33) at connection 361. Arms 362 may be severed and moved to another appropriate location connected with overall housing 303 so that a user can push the device 300 back and forth for sweeper operation.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A floor sweeper comprising:

(a) two or more rotation elements arranged side by side in an interlocked manner along a rotation axle, said rotation axle being supported within a front housing so that the rotation elements are rotatable by a drive means in a forward direction, where the rotation elements are adapted to rotate as a single assembly around the rotation axle;

(b) rotation elements each comprising an axis piece defining an axial bore which supports the rotation element on the rotation axle and from which axially extend two or more rotation arms of equal length which terminate in a spatulate paddle, said spatulate paddles being substantially wider than the rotation arms and are adapted to terminate in extended edges generally parallel to the axial bore;

(c) the front housing extending upward to a user handle and downwardly defining a sweeping opening adapted so that, upon rotation of the rotation elements, a lower portion of said spatulate paddles extend beyond lowest edges of the front housing and sweep across a floor surface upon which the floor sweeper is adapted to move;

(d) a set of wheels adapted to allow a user to cause the floor sweeper to be pushed and pulled across the floor surface in a direction normal to the rotation axle;

(e) a waste receptacle housing defining a waste opening in a front end and a waste receiving space rearward of the waste opening, where a front portion of the waste receptacle is secured so that the waste opening opens to the interior of the front housing so that the spatulate paddles of step (c), after sweeping said floor surface, sweep upwardly across the waste opening so that particles swept from the floor surface are released into the waste receiving space; and (f) wherein the front housing is rotatable about the rotation axle with respect to the waste receptacle.

2. The floor sweeper of claim 1 wherein drive means comprise a battery powered motor located in the front housing effectively connected to the rotation elements.

3. The floor sweeper of claim 2 wherein said motor extends to a first pulley wheel located outside the front housing and is connected by a drive belt to a second pulley wheel, which in turn is interlocked with at least one of the rotation elements.

4. The floor sweeper of claim 3 wherein a side housing encloses the belt and first and second pulley wheels.

5. The floor sweeper of claim 4 wherein the battery is rechargeable.

6. The floor sweeper of claim 1 wherein the waste receptacle housing comprises a top housing and a bottom housing, whereby the top housing is connected by a hinge to the bottom housing at a front edge of the top housing so that the top housing can be opened to dispose of waste that accumulates in the waste receiving space.

7. A floor sweeper comprising a user handle, a front housing, a wheel means, and a waste receptacle:

(a) three or more rotation elements arranged side by side in an interlocked manner along a rotation axle, said rotation axle being supported within the front housing so that the rotation elements are rotatable by way of a battery operated motor in a forward direction, where the rotation elements are adapted to rotate as a single assembly around the rotation axle;

(b) rotation elements each comprising an axis piece defining an axial bore which supports the rotation element on the rotation axle and from which axially extend three rotation arms of equal length equally radially spaced apart and which terminate in a spatulate paddle, said spatulate paddles being substantially wider than the rotation arms and are adapted to terminate in extended edges generally parallel to the axial bore;

(c) the front housing extending upward to a user handle and downwardly defining a sweeping opening adapted so that, upon rotation of the rotation elements, a lower portion of said spatulate paddles extend beyond lowest edges of the front housing and sweep across a floor surface upon which the floor sweeper is adapted to move;

(d) the wheel means adapted to allow a user to cause the floor sweeper to be pushed and pulled across the floor surface in a direction normal to the rotation axle;

(e) the waste receptacle housing defining a waste opening in a front end and a waste receiving space rearward of the waste opening, where a front portion of the waste receptacle is secured so that the waste opening opens to the interior of the front housing so that the spatulate paddles of step (c), after sweeping said floor surface, sweep upwardly across the waste opening so that particles swept from the floor surface are released into the waste; and (f) the front housing is rotatable about the rotation axle with respect to the waste receptacle.

8. The floor sweeper of claim 7 wherein drive means comprise a battery powered motor located in the front housing effectively connected to the rotation elements.

9. The floor sweeper of claim 8 wherein said motor extends to a first pulley wheel located outside the front housing and is connected by a drive belt to a second pulley wheel, which in turn is interlocked with at least one of the rotation elements.

10. The floor sweeper of claim 9 wherein a side housing encloses the belt and first and second pulley wheels.

11. The floor sweeper of claim 10 wherein the battery is rechargeable.

12. The floor sweeper of claim 7 wherein the waste receptacle housing comprises a top housing and a bottom housing, whereby the top housing is connected by a hinge to the bottom housing at a front edge of the top housing so that the top housing can be opened to dispose of waste that accumulates in the waste receiving space.

13. A floor sweeper rotation element assembly connected with a support housing comprising:

(a) a rotation cylinder having a first outside diameter on a first surface, a first axis, a connection end, and an open end defining therein an open ended bore having a first inside diameter;

(b) a motor connector cylinder having the outside diameter of the rotation cylinder on a second surface, a second axis, a connection end, and an open end defining therein an open ended bore having a second inside diameter;

(c) a rotation connection between the rotation cylinder and the motor connection cylinder at their respective connection ends such that the first and second axes are aligned;

(d) two or more rotation elements arranged side by side in an interlocked manner and fixed along the first and second surfaces;

(e) rotation support means comprising cylindrical supports having outside diameters about equal to the first and second inside diameters and rotatably extending out of the open ends of the rotation cylinder and the motor connector cylinder to connect with said support housing; and (f) an electric motor fixed within the rotation support means extending from the motor connection cylinder, said electric motor having a drive shaft extending into a connection with the connection end of the motor connection cylinder and having electrical drive means comprising battery power and electrical connections thereto.

* * * * *